US005151634A

United States Patent [19]

Nepote et al.

[11] Patent Number: 5,151,634

[45] Date of Patent: Sep. 29, 1992

[54] DEVICE FOR CONTROLLING A GAS-DISCHARGE LAMP FOR USE IN A MOTOR VEHICLE

[75] Inventors: Andrea Nepote, Turin; Marcello Boella, Ivrea, both of Italy

[73] Assignee: Marelli Autronica SpA, Milan, Italy

[21] Appl. No.: 779,858

[22] Filed: Oct. 21, 1991

[30] Foreign Application Priority Data

Oct. 22, 1990 [IT] Italy ..... 67812 A/90

[51] Int. Cl.[5] ..... H05B 37/02; H05B 41/36

[52] U.S. Cl. ..... 315/307; 315/82; 315/224; 315/287; 315/DIG. 7

[58] Field of Search ..... 315/307, DIG. 7, 82, 315/224, 287

[56] References Cited

U.S. PATENT DOCUMENTS

| | | | |
|---|---|---|---|
| 4,004,188 | 1/1977 | Cooper | 315/224 X |
| 4,240,009 | 12/1980 | Paul | 315/224 |
| 4,511,195 | 4/1985 | Barter | 315/307 X |
| 4,749,913 | 6/1988 | Stuermer et al. | 315/DIG. 7 X |
| 5,039,921 | 8/1991 | Kakitani | 315/307 |
| 5,047,695 | 9/1991 | Allen et al. | 315/82 |
| 5,068,578 | 11/1991 | Wegener | 315/307 |

*Primary Examiner*—Eugene R. LaRoche
*Assistant Examiner*—Son Dinh
*Attorney, Agent, or Firm*—Sughrue, Mion, Zinn, Macpeak & Seas

[57] ABSTRACT

The device includes a circuit for generating signals indicative of a reference current which is variable in steps and, during successive time intervals defined by a clock-signal generator, decreases according to respective predetermined functions as the voltage detected across the lamp increases, these functions corresponding substantially to respective predefined constant values of the power supplied to the lamp, and a differential comparator circuit which compares the values of the reference current generated with the current detected in the lamp and generates an error signal in dependence on the difference between them. The error signal can be used to control the device for supplying the lamp.

7 Claims, 3 Drawing Sheets

DEVICE FOR CONTROLLING A GAS-DISCHARGE LAMP FOR USE IN A MOTOR VEHICLE

DESCRIPTION

The present invention relates to a device for controlling a gas-discharge lamp, particularly for use in a motor vehicle, including:

a supply device for the lamp, having an input for connection to the battery of the vehicle and an output for connection to the lamp and including an inverter with a control input for receiving a control signal which can modify the electrical power supplied to the lamp, regulating circuitry connected to the lamp and to the control input of the supply circuit for detecting the voltage across the lamp and the current flowing through the lamp and for applying to the control input of the supply device a control signal for causing a high electrical power to be supplied during the switching-on and warming-up of the lamp and a subsequent reduction of the power to a predetermined operating level.

Gas-discharge lamps or GDLs have been proposed recently for use in motor vehicles, particularly for dipped headlights. These lamps have to be supplied with a high electrical power when they are switched on in order rapidly to evaporate the metal halides and the mercury they contain in order to generate visible light with a rich spectrum.

For use in motor vehicles, the lamp must light quickly.

Various operating methods have been proposed for supplying a gas-discharge lamp for automotive use during the warm-up stage and these generally provide for the supply of a high power during the switching-on stage until the voltage across the lamp reaches a certain value and a subsequent reduction to a lower running power.

Figure 1:
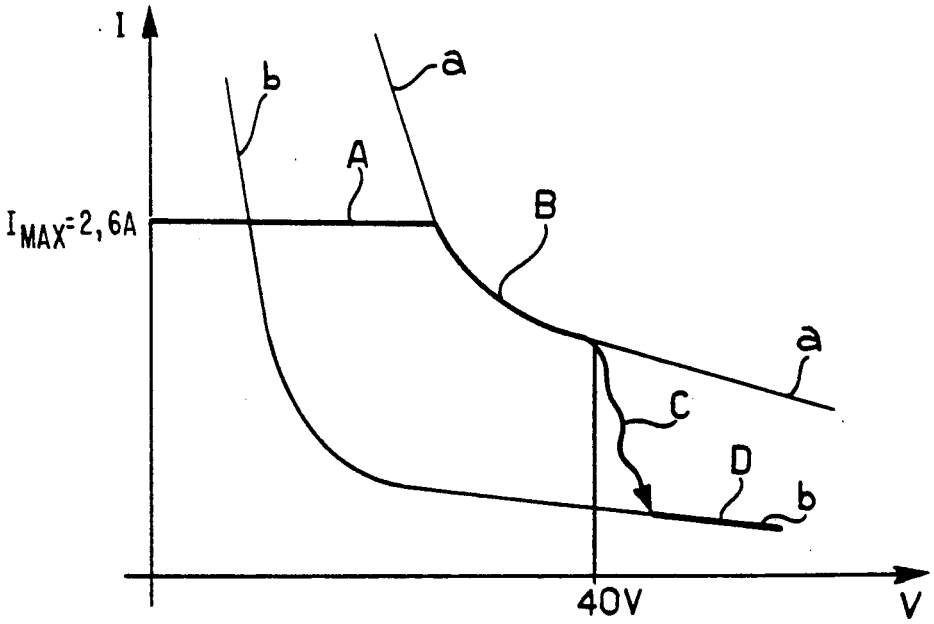

In particular, the VEDILIS (Vehicle Discharge Light System) project sponsored by the European Economic Community proposes the "outline" shown in FIG. 1 of the appended drawings. This drawing shows a graph of the current I flowing in the lamp on the ordinate as a function of the voltage V across the lamp on the abscissa. This graph shows two hyperbolic curves a and b which correspond to two constant powers (P=VI), for example, of 75 W and 35 W respectively. The VEDILIS project recommends that the lamp is supplied with a maximum current $I_{MAX}$ of 2.6 amperes (effective value) during the warm-up stage, that is, until a supply of 75 W is reached, as indicated by the line A in the graph of FIG. 1. The hyperbola a represents the upper limit of the power to be supplied to the lamp. The outline defined by the VEDILIS project therefore provides for a hyperbolic limit line B on the hyperbola a from the limit line A to the attainment of a voltage of 40 V across the lamp. When this voltage is reached, the power supplied to the lamp must be reduced gradually in an arbitrary manner until it reaches the hyperbola b corresponding to the operating power, for example 35 W, to be supplied to the lamp. The limit lines relating to transitions between the hyperbolas a and b and to the final line of the hyperbola b are indicated C and D in FIG. 1.

According to the directives issued under the VEDILIS project, the lines A, B, C and D must not be crossed during the piloting of a gas-discharge lamp. The time curve of the luminous flux generated by a gas-discharge lamp changes appreciably, however, during the piloting of the lamp, according to movements within the I,V plane under the limit outline defined above. Typically, the luminous flux has an initial peak and then a sudden drop to a minimum value followed by a gradual increase to a final limit value. If a gas-discharge lamp is piloted in a manner exactly corresponding to the lines A, B, C and D defined in FIG. 1, the luminous flux has a marked initial peak (overshoot) followed by a sudden drop and then starts to increase gradually to a limit value. The initial peak of the luminous flux and the sudden drop which immediately follows it are particularly problematical.

In particular, it has been found that the duration and relative values of the initial peak and the following reduction in brightness are particularly affected by the manner in which the transition is made from the power level associated with the hyperbola a to the operating power level corresponding to the hyperbola b.

In order to solve this problem, it has been proposed to use systems based on optical feedback: a light sensor associated with the lamp provides a signal which is used to pilot the variation of the power supplied to the lamp. This solution is complicated, however, and requires the use of an additional sensor which creates many problems in applications in which the lamp is used in an automotive environment.

The object of the present invention is to provide a system for controlling a gas-discharge lamp of the type specified above which achieves a good time curve for the luminous flux emitted without the need for an optical feedback system.

According to the invention, this object is achieved by means of a control device of the type specified above, the main characteristic of which lies in the fact that the regulating circuitry comprises:

means for generating signals indicative of a reference current which is variable in steps and, during successive time intervals defined by à clock-signal generator, decreases according to respective predetermined functions as the voltage detected across the lamp increases, these functions corresponding substantially to respective predefined constant values of the power supplied to the lamp, and comparator means for comparing the reference-current values generated with the current detected in the lamp and, in dependence on the difference between them, generating an error signal usable for generating the control signal for the device for supplying the lamp.

Figure 2:
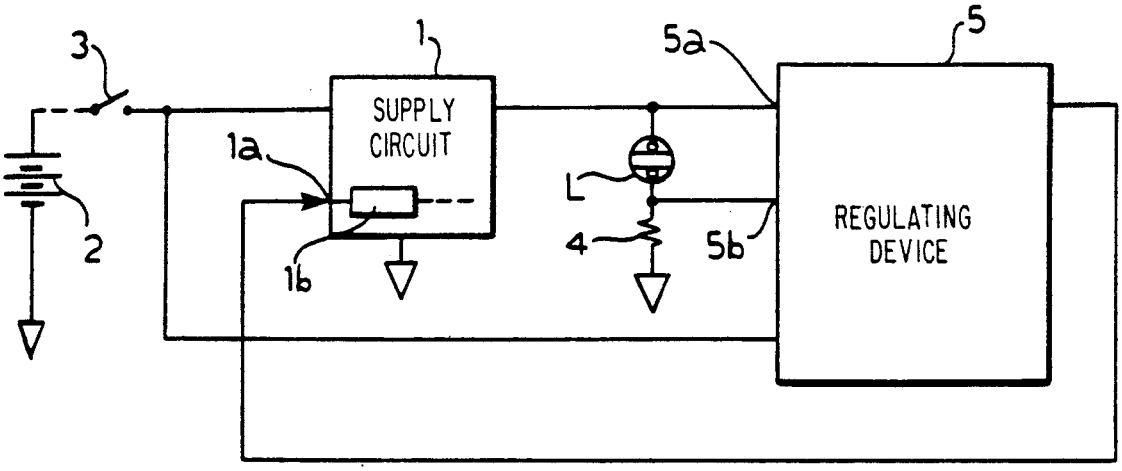
Figure 3:
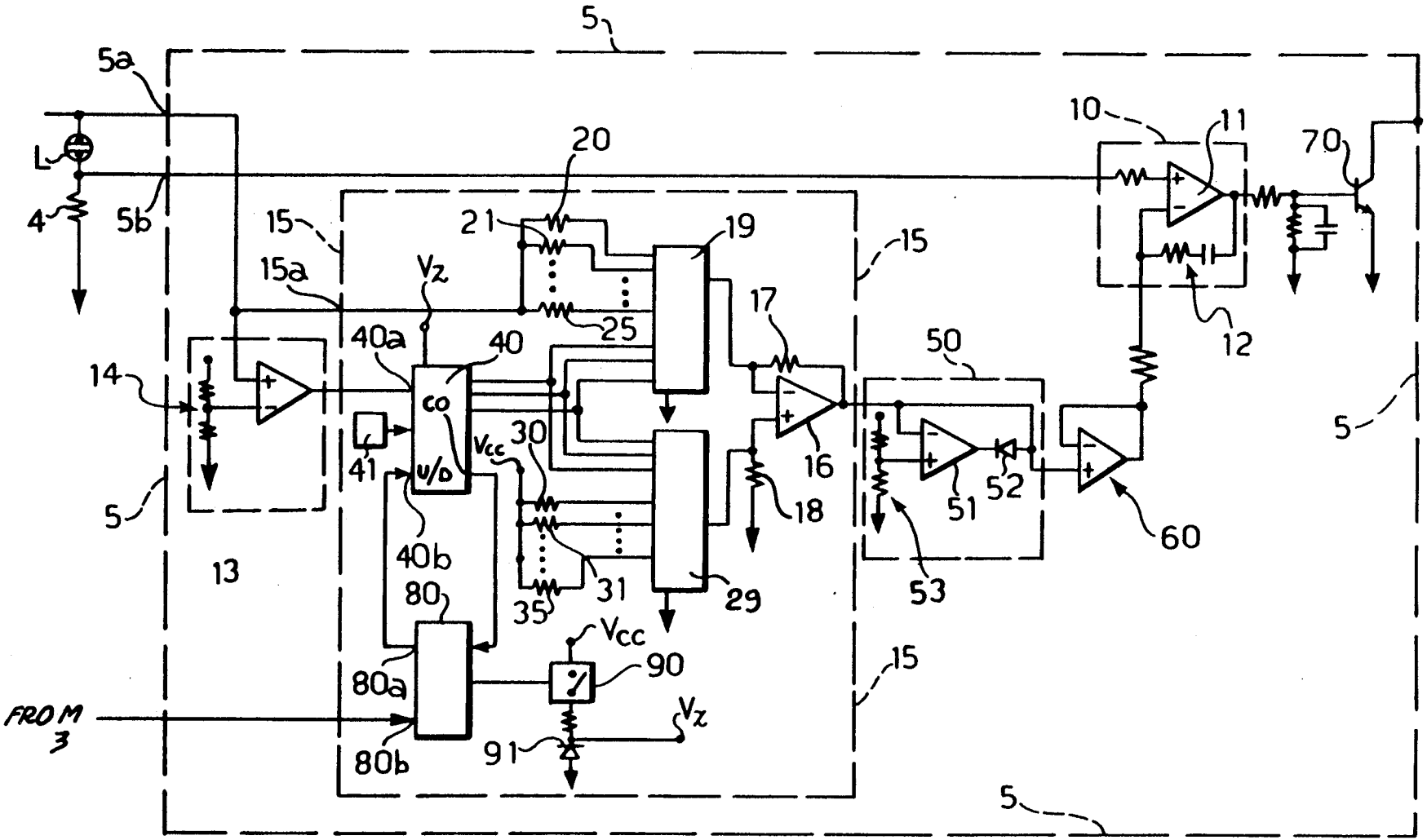
Figure 4:
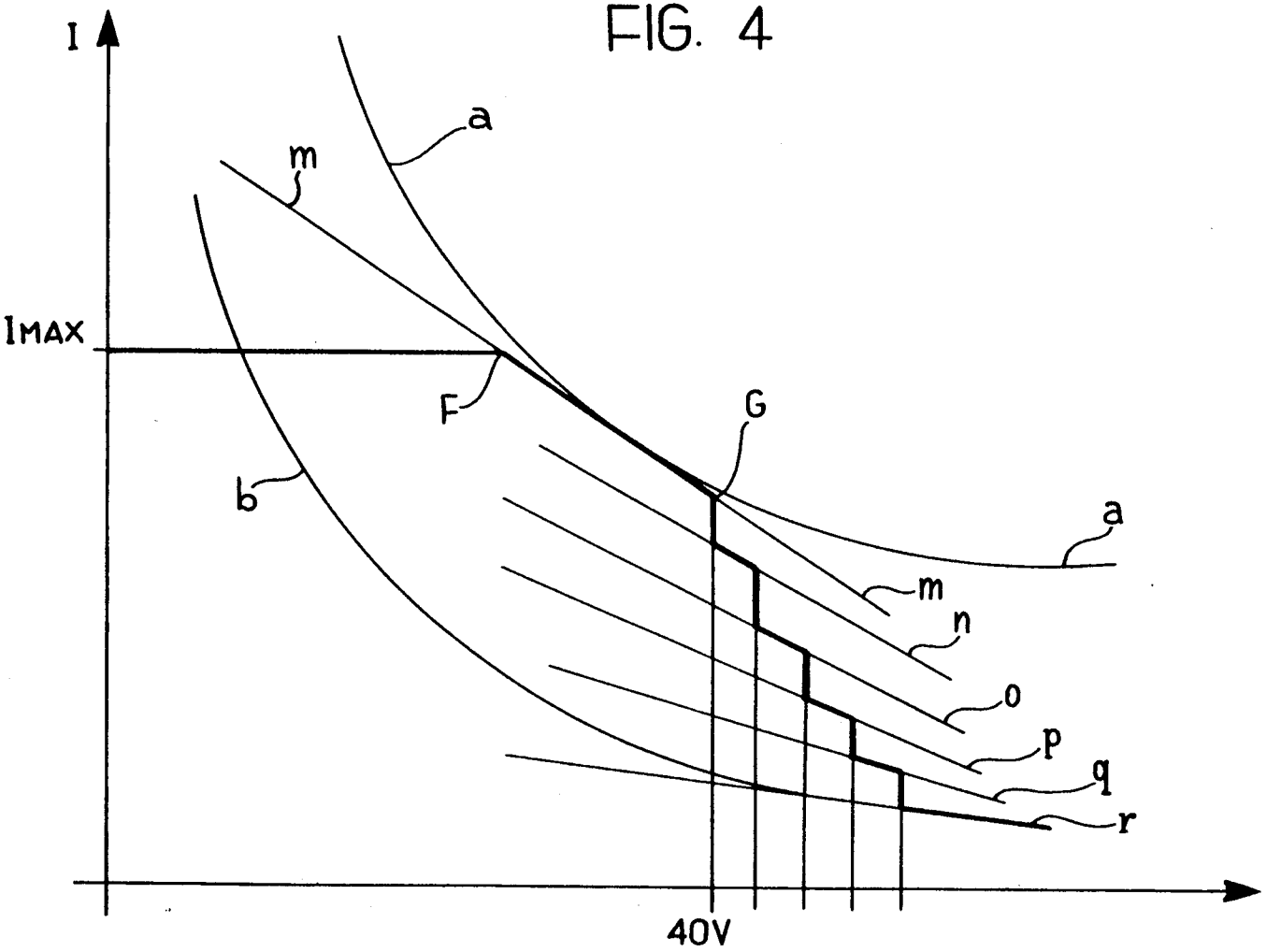

Further characteristics and advantages of the invention will become clear from the detailed description which follows with reference to the appended drawings, provided purely by way of non-limiting example, in which:

FIG. 1, which has already been described, is a graph showing the curves relating to the mode of supply of a gas-discharge lamp according to the recommendations issued under the VEDILIS project, FIG. 2 is a block diagram of a device according to the invention for controlling a gas-discharge lamp, FIG. 3 is a more detailed electrical diagram showing an embodiment of a regulating device included in the control device of FIG. 2, and FIG. 4 is a graph similar to that of FIG. 1, showing the way in which a gas-discharge lamp is piloted by a device according to the invention.

In FIG. 1, a gas-discharge lamp is indicated L. The lamp is connected to the output of a supply device 1 of known type whose input can be connected to the battery 2 of the vehicle by the operation of a control switch 3.

A resistor 4 is connected between the lamp L and earth.

A regulating device, generally indicated 5, has an input 5*a* connected to the terminal of the lamp L which is connected to the supply 1 and an input 5*b* connected to the non-earthed terminal of the resistor 4. In operation, the inputs 5*a* and 5*b* of the regulating device 5 receive voltage signals indicative of the voltage applied to the terminals of the lamp L and of the current flowing through the lamp, respectively.

The supply device 1 (in known manner) includes, for example, an inverter 1*b* with a control input 1*a* for receiving a control signal which can modify the electrical power supplied to the lamp L.

In operation, the regulating device 5 generates a control signal on the basis of the detected values of the voltage across the lamp L and of the current flowing through the lamp and the signal is applied to the control input 1*a* of the supply device so as to drive the inverter 1*b* in a manner such that the voltage and the current in the lamp behave in a predetermined manner during the switching-on and warming-up stages.

An embodiment of the regulating device 5 based on the use of non-programmed electronic logic circuits will now be described with reference to FIG. 3. As will be confirmed below, however, the functions performed by the regulating device which will now be described may be carried out with the use of a programmed logic system, that is, a system including a microprocessor.

In the embodiment shown by way of example in FIG. 3, the regulating device 5 includes a comparator circuit 10 including a differential amplifier 11 with an RC feedback loop 12 between its inverting input and its output. The non-inverting input of the amplifier is connected to the non-earthed terminal of the resistor 4.

The terminal of the lamp L which is not connected to the resistor 4 is connected to the input of a threshold comparator 13 which compares the voltage across the lamp (the voltage across the resistor 4 being negligible) with a reference voltage generated by a resistive divider 14.

An amplifier circuit, generally indicated 15, has an input 15*a* connected to the input terminal 5*a* of the regulating circuit 5 and hence to the lamp L.

The amplifier 15 outputs a signal $V_u$ which varies in dependence on the signal $V_i$ supplied to its input 15*a* according to a linear law of the type:

$$V_u = g\ V_i + h$$

in which g and h are two constants which are negative and positive respectively.

The amplification circuit 15 includes an operational amplifier 16 with a feedback resistor 17 between its inverting input and its output and a resistor 18 between its non-inverting input and earth.

The inverting input of the amplifier 16 is connected to the output of a multiplexer 19 having a plurality of inputs to which first terminals of (for example, six) resistors, indicated 20 to 25, are connected, the second terminals thereof being connected to each other and to the input terminal 5*a*.

The non-inverting input of the operational amplifier 16 is connected to the output of a multiplexer 29 having a plurality of inputs connected to first terminals of (for example six) resistors 30, 31 . . . 35. The other terminals of these resistors are connected to a stabilised direct-current voltage supply $V_{cc}$ (not shown).

Each multiplexer 19 or 29 has three addressing inputs connected to the outputs of a counter 40 with an input connected to the output of an oscillator 41 which acts as a clock-pulse generator. The counter 40 has an enabling input 40*a* connected to the output of the threshold comparator 13.

In operation, when the threshold comparator 13 enables the counter 40 to count, the latter outputs address bit-combinations in sequence at a rate defined by the clock-pulse generator 41. The sequence of the addresses is such that the inverting and non-inverting inputs of the operational amplifier 16 are first connected respectively to the resistors 20 and 30 and then to the resistors 21 and 31, and so on. The amplifier circuit 15 applies different laws for decreasing its output signal linearly in dependence on its input signal, according to which pair of resistors is connected selectively to the inverting and non-inverting inputs of the operational amplifier 16.

The output of the amplification circuit 15 is connected to the input of a chopper or limiter circuit 50 which limits the amplitude of the signal to a predetermined value. The limiter or chopper circuit 50 is formed in known manner with the use of an operational amplifier 51, a rectifier diode 52 and a voltage divider 53 connected in the manner shown in FIG. 3. The output of the limiter circuit is connected to the inverting input of the differential comparator circuit 10 by means of a voltage-follower disconnection stage 60.

The amplification circuit 15, the limiter 50 and the amplifier 60 together constitute a chain which supplies the differential comparator circuit 10 with a reference signal indicative of a reference value for the current in the lamp L, which is variable in steps and, during successive time intervals defined by the clock-pulse generator 41, decreases according to respective predetermined functions as the voltage across the lamp increases; the functions conveniently correspond to predefined constant values of the power supplied to the lamp, the power values being between those associated with the hyperbola a and the hyperbola b of FIGS. 1 and 4.

The differential comparator circuit 10 supplies an output signal to the base of a driver transistor 70 whose collector represents the output of the regulating device 5 as a whole.

In operation, when the lamp L is switched on as a result of the closure of the switch 3, the voltage across the lamp is kept quite low, below the threshold associated with the comparator 13. The latter therefore stops the counter 40. In this condition, the output (000) of the counter 40 causes the multiplexers 19 and 29 to connect the resistors 20 and 30 to the operational amplifier 16. The resistances of these resistors are such that the voltage output by the amplifier 15 corresponds to a reference value for the current in the lamp which decreases linearly in dependence on the voltage across the lamp, according to a straight line m (FIG. 4) tangential to a point on the portion B of the hyperbola a. During the switching-on stage, for low voltages across the lamp L, the straight line m corresponds to currents higher than the value $I_{max}$ and the chopper circuit 50 therefore limits the amplitude of the signal output by the amplification circuit so that the differential comparator circuit 10 drives the transistor 70 in a manner such that the supply device 1 tends to keep the current in the lamp substantially constant and equal to the value $I_{max}$.

The intervention of the chopper circuit 50 ceases as soon as the voltage and the current in the lamp L reach values corresponding to the point indicated F in FIG. 4. From this point and until the point indicated G, corresponding to a voltage of 40 V across the lamp, is reached, the amplification circuit 15 applies to the inverting input of the differential comparator circuit 10 a signal corresponding to a reference current which effectively decreases according to the straight line m of FIG. 4.

As soon as the voltage across the lamp reaches the value of 40 V (the point G in FIG. 4) the threshold comparator 13 enables the counter circuit 40 to count. The counter sends addressing signals to the multiplexers 19 and 29 such that the resistors 21 and 31 are now connected to the operational amplifier 16. The amplification circuit 15 then applies to the differential comparator circuit 10 a signal indicative of a reference current which decreases linearly according to the straight line n of FIG. 4.

The operation then continues in a similar manner and, during successive time intervals defined by the clock-pulse generator 41, the reference value for the current in the lamp generated by the amplification circuit 15 behaves successively according to portions of successive straight lines, indicated o, p, q and r in FIG. 4.

The final straight line r is tangential to a point on the portion D of the hyperbola b of FIG. 1 and thus approximates to the constant-power hyperbola corresponding to the operating power to be supplied to the lamp L.

Conveniently, the counter 40 is of the bidirectional (up/down) type and has an input, indicated 40*b*, for controlling the direction of counting. This input of the counter 40 is connected to an output 80*a* of a logic circuit 80 which has a further input 80*b* connected to the input of the supply device 1, downstream of the switch 3 which switches the lamp L on and off. The input 80*b* of the logic circuit 80 is intended, in particular, to detect the opening of the switch 3 to switch off the lamp. When the switch 3 is opened, the logic circuit 80 causes the counter 40 to count backwards (decremental counting) at a predetermined rate. If the switch (3) is closed again immediately after it has been opened, the count of the counter 40 does not start again from 000 (the address corresponding to the application of the straight line m of FIG. 4) but starts from a count or address corresponding to an intermediate straight line, so as not to repeat the entire warm-up stage which would be unnecessary and could damage the lamp.

If the counter returns to 000 after the switch 3 has been opened, the counter supplies a signal from an output CO (the "carry-out" output) to the logic circuit 80 which opens a switch 90 to cut off the supply to the counter 40. In effect, the counter is supplied with the voltage $V_z$ developed across a Zener diode 91 between the switch 90 and earth.

The regulating circuit according to FIG. 3 thus enables the lamp L to be controlled according to the graph of FIG. 4.

The number of approximating straight lines used in the transition between the power levels associated with the hyperbolas a and b may be larger or smaller than that shown by way of example.

The regulation method of the invention may also be carried out by a programmed logic device, that is, with the use of a microprocessor. In this case, the transition from the warm-up power level to the operating power level can be achieved by varying the reference current in steps so that, during successive time intervals, it decreases according to hyperbolic functions and not according to approximating straight lines.

With reference to the embodiment of FIG. 3, if a simple logic circuit which can easily be produced by an expert in the art is interposed between the counter 40 and the multiplexers 19 and 29, one can arrange for the periods during which the reference current varies according to a particular approximating straight line of FIG. 4 not to be equal, but to be whole multiples of the period of the clock-pulse generator. Naturally, this can also be achieved very easily in an embodiment with a microprocessor.

It may be convenient to be able to vary the period during which the reference current varies according to a particular straight line (or hyperbola) especially in order to delay, that is, to slow down, the reaching of the hyperbola b which corresponds to the operating power of the lamp.

In embodiments with a microprocessor, the voltage reached across the lamp when it is running can be stored. This information can be used when the lamp is subsequently switched on again in order correspondingly to control the power supplied to the lamp during the warm-up stage.

Naturally, the principle of the invention remaining the same, the forms of embodiment and details of construction may be varied widely with respect to those described and illustrated purely by way of non-limiting example, without thereby departing from the scope of the present invention.

We claim:

1. A device for controlling a gas-discharge lamp for use in a motor vehicle, including:

a supply device for the lamp, having an input for connection to the battery of the vehicle and an output for connection to the lamp and including an inverter with a control input for receiving a control signal which can modify the electrical power supplied to the lamp, and regulating circuitry connected to the lamp and to the control input of the supply circuit for detecting the voltage across the lamp and the current flowing through the lamp and for applying to the control input of the supply device a control signal for causing a high electrical power to be supplied during the switching-on and warming-up of the lamp and a subsequent reduction of the power to a predetermined operating level;

the regulating circuitry comprising:

means for generating signals indicative of a reference current which is variable in steps and, during successive time intervals defined by a clock-signal generator, decreases according to respective predetermined functions as the voltage detected across the lamp increases, wherein the functions correspond to respective predefined constant values of the power supplied to the lamp, and comparator means for comparing the reference-current values generated with the current detected in the lamp and, in dependence on the difference between them, generating an error signal usable for generating the control signal for the supply device.

2. A device according to claim 1, wherein the generator means are arranged to generate signals indicative of a variable reference current which decreases according to linear functions during successive time intervals.

3. A device according to claim 1, wherein the generator means are arranged to generate signals indicative of a variable reference current which decreases according to hyperbolic functions during successive time intervals.

4. A device according to claim 1, wherein the generator means comprise:

an amplification circuit for outputting a signal which is variable selectively according to a plurality of predefined linear laws in dependence on the signal supplied to an input of said amplification circuit, the amplification circuit being intended to receive a signal indicative of the voltage across the lamp in operation.

5. A device according to claim 4, wherein a chopper or limiter circuit is connected to the output of the amplification circuit for limiting the signal supplied by the amplification circuit to an amplitude corresponding to a predetermined maximum value for the reference current.

6. A device according to claim 1, wherein the generator means and the comparator means are formed by a microprocessor system.

7. A device according to claim 6, wherein the microprocessor system is arranged to store the value of the voltage reached across the lamp during operation each time the lamp is switched on and, on the basis of the stored information, correspondingly to attenuate the electrical power supplied to the lamp during the warm-up stage.

* * * * *